US007001192B1

(12) United States Patent
Yeh

(10) Patent No.: US 7,001,192 B1
(45) Date of Patent: Feb. 21, 2006

(54) STRUCTURE OF CONNECTOR

(76) Inventor: Ming-Hsiang Yeh, 14F, No. 375, Nan-Gang District, Fu De Street, Taipei City (TW)

( * ) Notice: Subject to any disclaimer, the term of this patent is extended or adjusted under 35 U.S.C. 154(b) by 0 days.

(21) Appl. No.: 10/981,571

(22) Filed: Nov. 5, 2004

(51) Int. Cl.
*H01R 13/44* (2006.01)
*H01R 13/60* (2006.01)
*H01R 29/00* (2006.01)

(52) U.S. Cl. ..... 439/131; 439/174; 439/172

(58) Field of Classification Search ..... 439/131, 439/171, 172, 173, 174, 175, 533
See application file for complete search history.

(56) References Cited

U.S. PATENT DOCUMENTS 6,210,231 B1 * 4/2001 Lai ..... 439/610
6,923,666 B1 * 8/2005 Liao ..... 439/172
2004/0097127 A1 * 5/2004 Smith et al. ..... 439/533
2005/0130468 A1 * 6/2005 Regen et al. ..... 439/131

* cited by examiner

*Primary Examiner*—Chandrika Prasad
(74) *Attorney, Agent, or Firm*—Troxell Law Office, PLLC

(57) ABSTRACT

An improved structure of a connector is disclosed. The connector comprises a terminal base having a plurality of connection terminals mounted thereon and a main frame, wherein the main frame is of U shape and slide tracks are mounted on vertical sidewalls thereof, and the terminal base is of L shape and the connection terminals and trenches are mounted respectively on the front end and sidewalls of the rear end of the terminal base. The terminal base is mounted upside down on the main frame to position the trenches of the terminal base within the slide tracks of the main frame. The push buttons are embedded in the trenches of the terminal base from the outside of the main frame such that the terminal base can slide within the main frame. As a result, the formed connector has a reduced size and forms a female socket and a male plug by slide of the push button.

7 Claims, 5 Drawing Sheets

STRUCTURE OF CONNECTOR

BACKGROUND OF THE INVENTION

The present invention relates to an improved structure of a dual-purpose connector that has reduced size, and this connector is applied to various wires, terminals, conversion terminals, conversion wires, terminals of the related apparatus, or the likes.

Computer is a major core of the current information processing, managing, or controlling procedures. In order to optimize the computer apparatus, peripheral apparatuses such as a printer, a scanner, a modem, etc are connected to the computer apparatus. However, these described peripheral apparatuses must use interface devices as channels to control thereof and communicate data. A USB (Universal Serial Bus) connector is especially a common connector. The advantage provided by the USB connectors is to unify connectors that have various specifications so as to overcome the conventional drawback of providing a specific connector for a specific apparatus. The USB connector integrates functions of various connectors. Therefore, the transmission speed, installation, and maintenance of the USB connector are better than that of the conventional unitary connector that has a connection interface, for example, COM 1, COM 2, LPT, etc.

Most of the general computer hosts provide two USB female sockets. The signal input end of the peripheral apparatus, for example, the scanner, connects to the computer host via a connection wire that has connectors mounted on two sides thereof. The end of the connection wire that couples with the computer host is a USB male plug for plugging into the USB female socket so as to transmit signal. Nevertheless, the USB connectors must be subdivided into the female socket and the male plug, which are mounted respectively on the computer host and various peripheral apparatuses or two ends of the connection wire, even though the utility rate of the USB connector is much higher.

An improved structure of a connector that has reduced size and can be randomly changed into a female socket or a male plug is disclosed in view of the aforementioned circumstances so as to unify the specifications of the connectors that mount on various peripheral apparatuses and connection wires. It is not necessary to subdivide the connector into a female socket or a male plug. Accordingly, the present inventor has been made diligent studies with a quiet mind to design and fabricate an improved structure of a connector. This connector is provided for the consumer in accordance with motivations of the present invention.

SUMMARY OF THE INVENTION

The main purpose of the present invention is to provide an improved structure of a dual-purpose connector that uses a USB connector having a unified specification as a female socket or a male plug.

Another purpose of the present invention is to provide an improved structure of a connector that has a reduced size and can be used together with a conventional USB male plug.

According to the aforementioned purposes of the present invention, an improved structure of a connector is disclosed. The connector comprises a terminal base having a plurality of connection terminals mounted thereon and a main frame, wherein the main frame is composed of a U-shaped insulating frame and a U-shaped plastic frame, which are stacked and connected with one another. Two tracks are mounted respectively on two vertical sidewalls of the main frame. Two trenches are formed respectively on the bottom of two sidewalls of the terminal base. A push button is provided on a position corresponding to each one of the trenches of the terminal base. The terminal base is mounted upside down on the main frame to position the trenches of the terminal base within the tracks of the main frame. The push buttons are embedded in the trenches of the terminal base from the outside of the main frame so as to form a containing room between the terminal base and the main frame for receiving a USB male plug. As a result, a USB connection is formed. A USB male plug is formed by pushing the push buttons to extend the terminal base from the main frame. According to the above description, a dual-purpose connector having reduced size is provided. The other features and preferred embodiments of the present invention will now be described with reference to the accompanying drawings.

DETAILED DESCRIPTION OF THE PREFERRED EMBODIMENT

Figure 2:
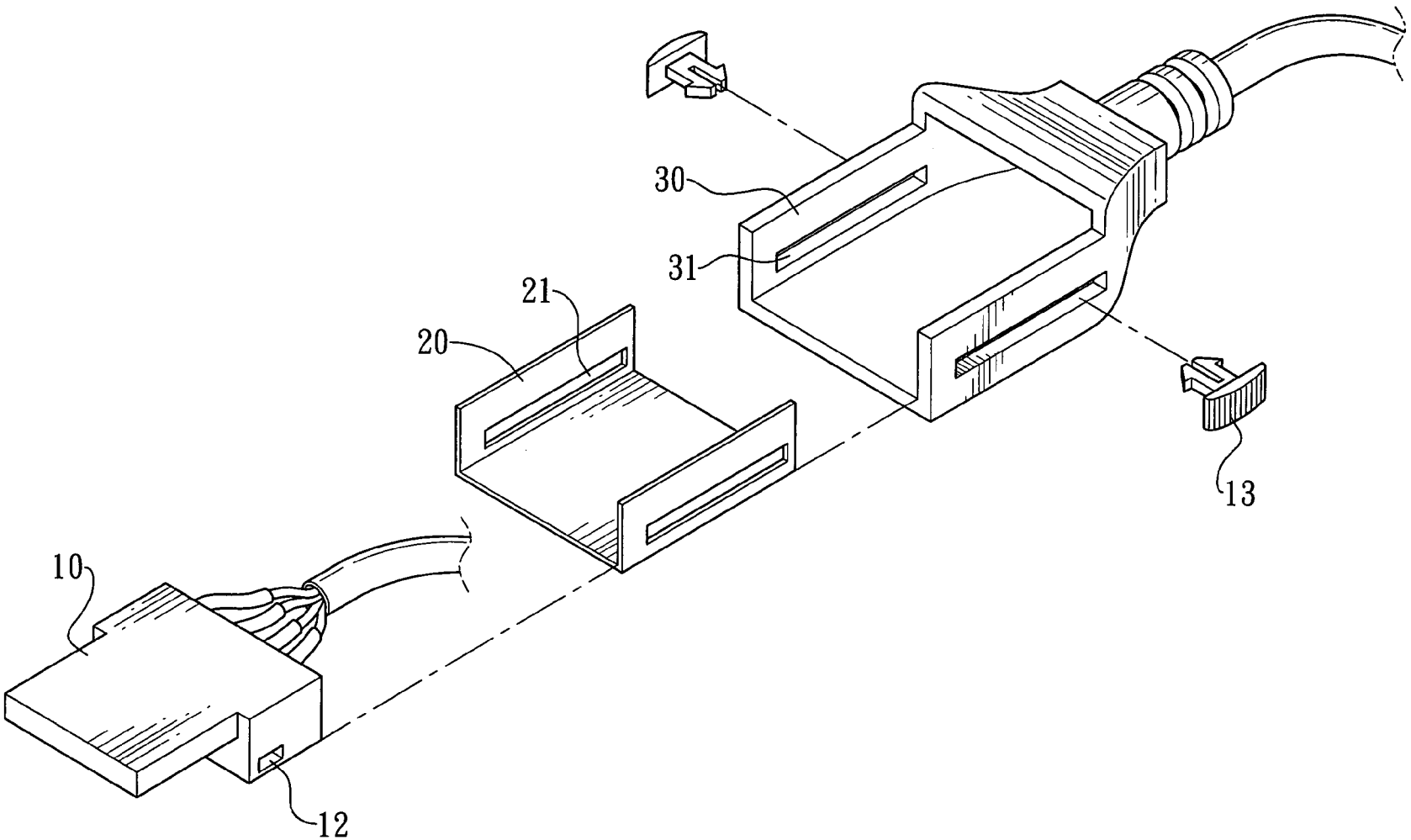
FIG. 2 is a decomposed view showing the preferred embodiment of the present invention.

Referring to FIG. 2, the connector 1 of the present invention comprises a terminal base 10 and a main frame, wherein the terminal base 10 is roughly of L shape. A plurality of connection terminals (not shown) are mounted orderly on the terminal base 10. A trench 12 is mounted respectively on lower portions of two sides of the terminal base 10. A push button 13 is coupled with the trench 12.

The main frame is formed by overlapping and combining a U-shaped insulating frame 20 with a U-shaped plastic frame 30. Besides, a track 21 and a track 31 are mounted respectively on two vertical sidewalls of the U-shaped insulating frame 20 and the U-shaped plastic frame 30. Therefore, when the insulating frame 20 is mounted inside the plastic frame 30, the track 21 and the track 31 overlap one another to form a track respectively on two sides of the main frame.

Figure 1:
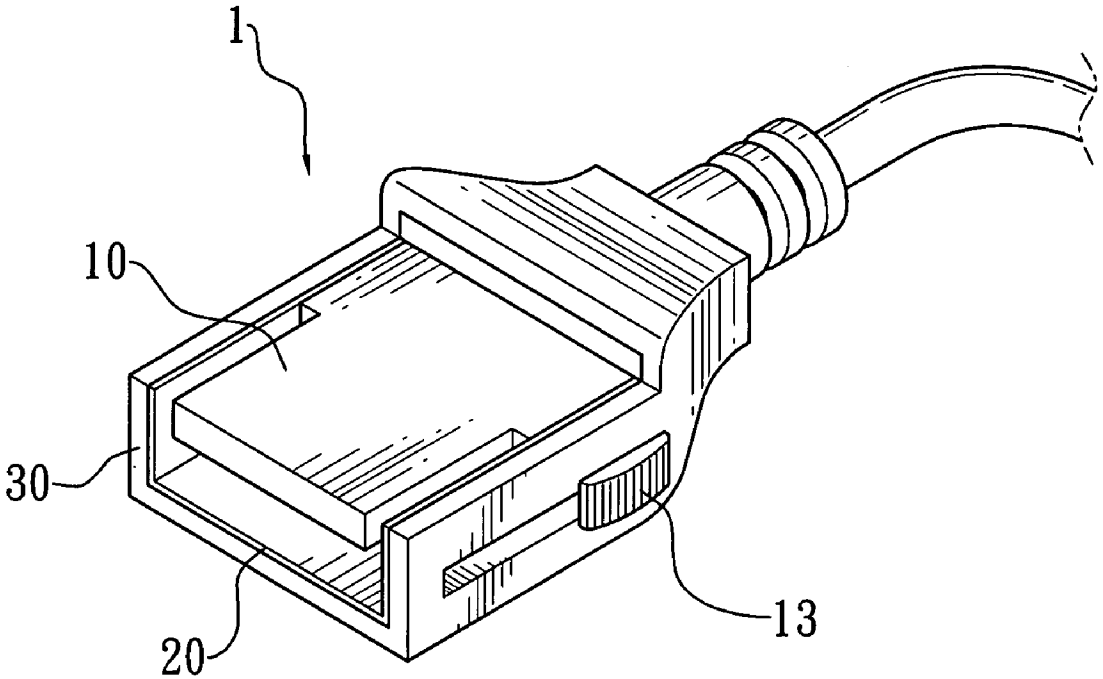
FIG. 1 shows an outward appearance of a preferred embodiment of the present invention.

During the assembling operation, the terminal base 10 is mounted upside down and the trenches 12 on two sides thereof are located within the tracks on two sides of the main frame so as to form a containing room between the terminal base 10 and the main frame. In addition, the push button 13 is embedded in the trench 12. As a result, the terminal base 10 is controlled by the push button 13, as shown in FIG. 1. When the push button 13 is located in an unpushing position, a female socket of a super-thin USB connector for receiving a male plug of a USB connector is thus formed.

Figure 3:
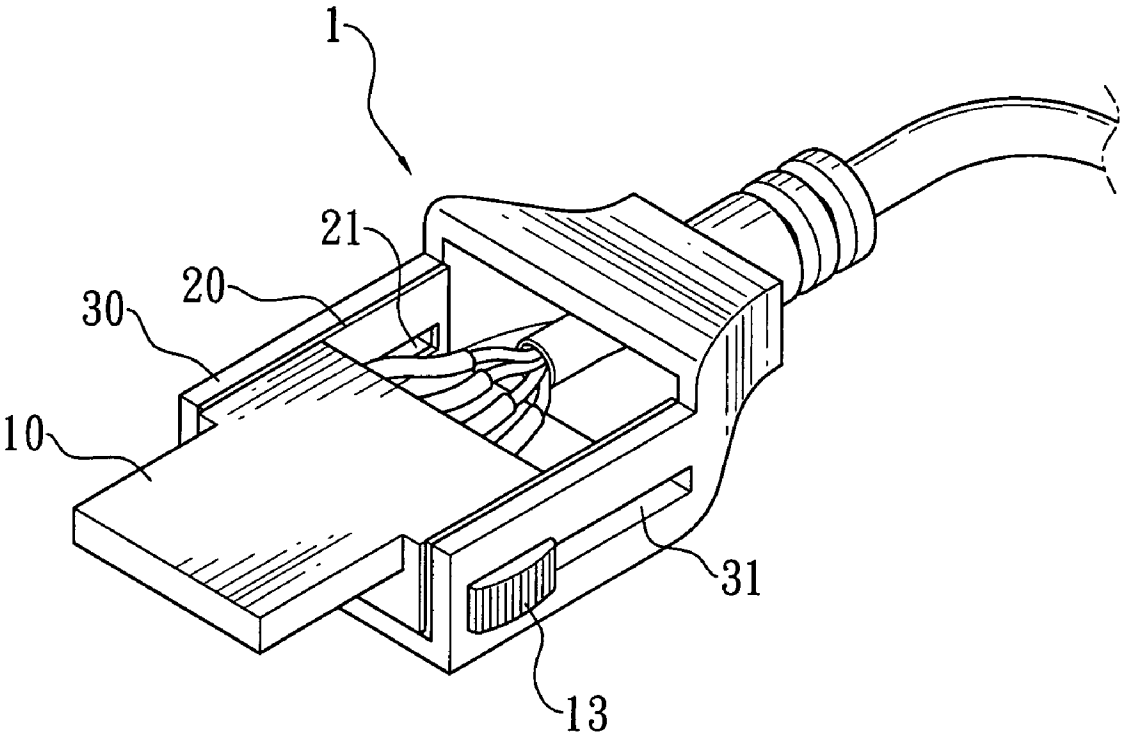
FIG. 3 shows another outward appearance of the preferred embodiment of the present invention.

Referring to FIG. 3, by forcing the push button 13 to slide within the tracks 21 and 31, the front end of the terminal base 10 extends from the main frame so as to form a male plug of a USB connector for plugging into the female socket of the USB connector.

Figure 4:
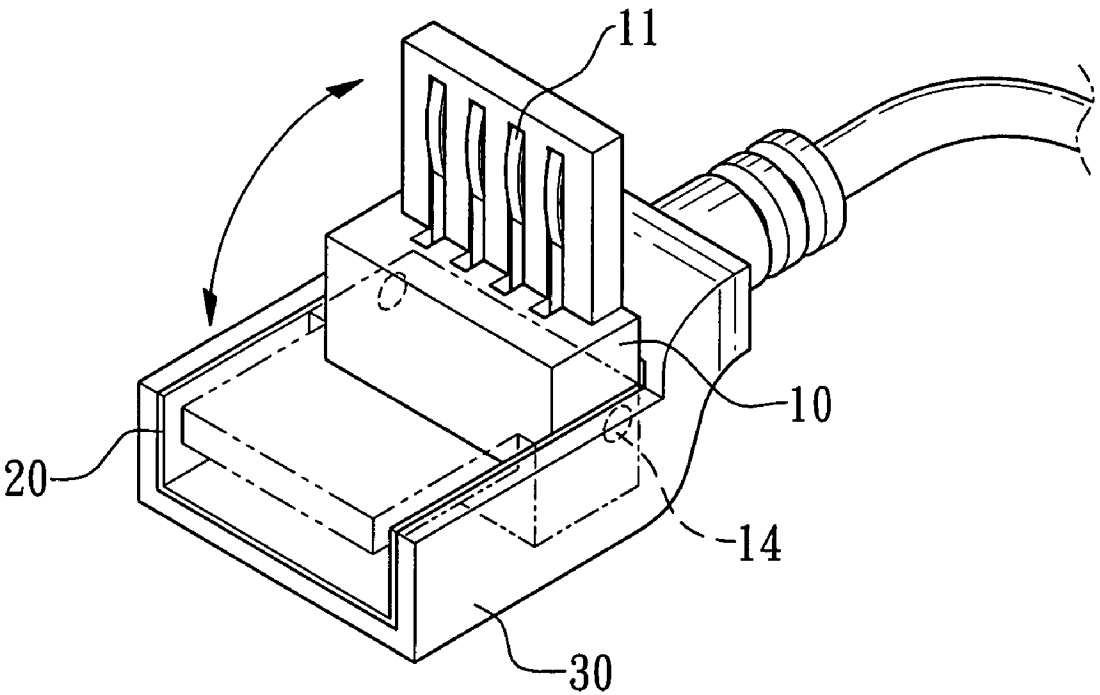
FIG. 4 is a schematic diagram showing usage status of a second preferred embodiment of the present invention.

Referring to FIG. 4, a second preferred embodiment of the present invention is shown. A rotating shaft 14 is mounted respectively on the rear ends of two sides of the terminal base 10. The main frame is formed by overlapping and combining a U-shaped insulating frame 20 with a U-shaped plastic frame 30. A shaft hole is formed respectively on two vertical sidewalls of the main frame. During the assembling operation, the rotating shafts 14 of the terminal base 10 pass through the shaft holes of the main frame to form a containing room between the terminal base 10 and the main frame. When the terminal base 10 is not lifted, a female socket of a super-thin USB connector for receiving a male plug of a USB connector is thus formed. In addition, the terminal base 10 is turned upward 90 degrees to form a connection terminal 11 of the connection base 10, wherein the connection terminal 11 extends from the main frame. As a result, a male plug of a USB connector is formed.

Figure 5:
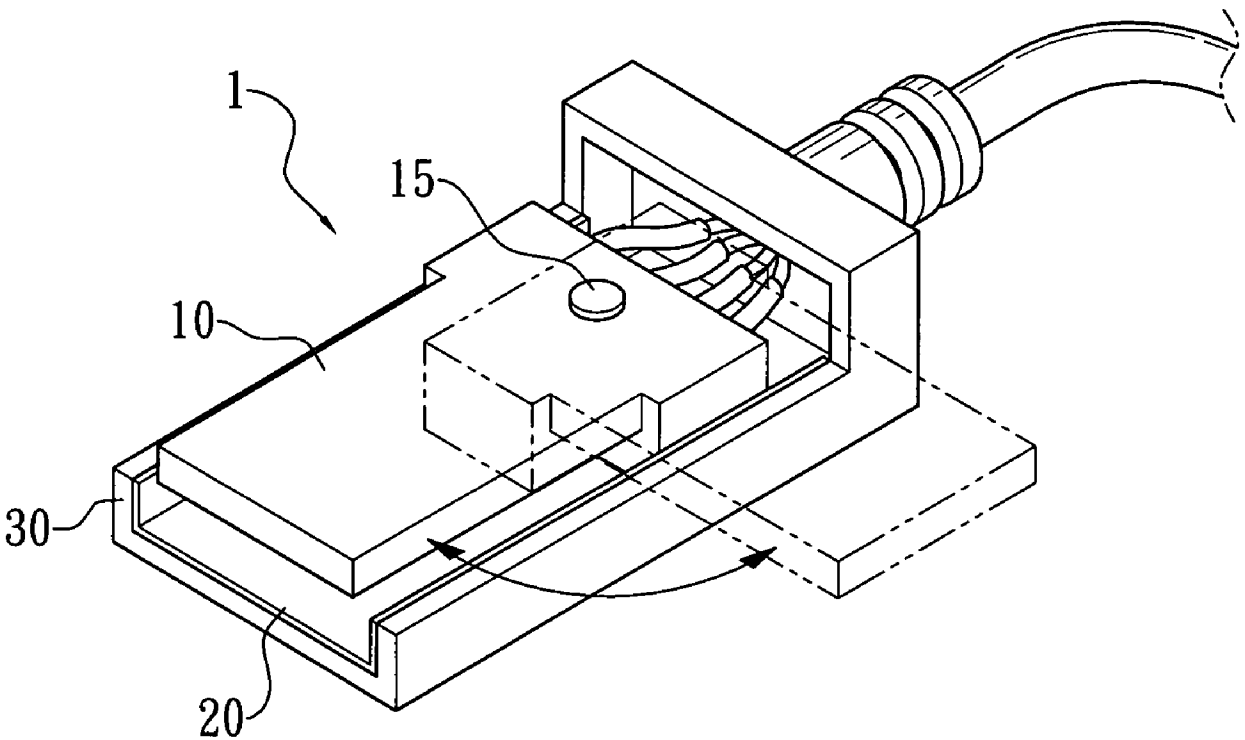
FIG. 5 is a schematic diagram showing usage status of a third preferred embodiment of the present invention.

Referring to FIG. 5, a third preferred embodiment of the present invention is shown. A coupling shaft 15 is mounted on the center portion of the bottom part of the surface where the connection terminal mounts. The main frame is formed by overlapping and combining a U-shaped insulating frame 20 with a U-shaped plastic frame 30. Two vertical sidewalls of the insulating frame 20 are shorter. The plastic frame 30 is of roughly U shape. The width of the plastic frame 30 is approximately larger than that of the insulating frame 20. Two vertical sidewalls of the plastic frame 30 are mounted on positions corresponding to the vertical sidewalls of the insulating frame 20. The plastic frame 30 has two bottoms that connect to one another and higher than two vertical sidewalls. As a result, when the insulating frame 20 overlaps and mounts in the plastic frame 30, the main frame is of L shape.

During the assembling operation, the coupling shaft 15 is pivotally coupled with the main frame thereby preventing the terminal base 10 from leaving the main frame. If no force is applied, the terminal base 10 is received inside the main frame to form a female socket of a super-thin USB connector for receiving a male plug of a USB connector. If the force is applied to the terminal base 10, the terminal 10 can rotate on both sides via the pivotal rotation of the coupling shaft 15 to enable the connection terminal to extend from the main frame by using the connected part of the plastic frame 30 to stop the terminal base 10. As a result, the connection terminal extends from the main frame to form a male plug of a USB connector.

According to the above description, it is apparent that the device of the present invention comprises the following practical advantages.

1. It is able to reduce the size of the USB connector that can be used as a female socket or a male plug by self-selection and adjustment. Thus, it is not necessary to subdivide the USB connector into a female socket or a male plug since the specifications of the USB connector are unified.

2. The terminal base can be pushed forward, lifted upward, or rotated away from the main frame by coupling with the main frame through the coupling shaft, the protrudent part, or the protrudent shaft so as to form a male plug that has various forms.

3. The connectors of the present invention pair with one another or with the conventional USB connector for use.

However, the above description merely illustrates the preferred embodiments of the present invention, and the applicable scope of the present invention is not limited hereto. Any obvious modification and revision made by a person skilled in the art are included within the spirit and scope of the present invention.

According to the above description, the present invention achieves the expected purposes of the present invention by providing with an improved structure of a dual-purpose connector that includes a male plug and a female socket and has reduced size. The application that complies with utility is therefore submitted for a patent.

What the invention claimed is:

1. An improved structure of a connector comprising:

a L-shaped terminal base having a plurality of connection terminal mounted orderly on one end of the terminal base and a trench mounted respectively on two sides of the terminal base for receiving a push button; and a main frame mated with a width of the terminal base, the main frame being formed by overlapping and combining a U-shaped insulating frame with a U-shaped plastic frame, a track being mounted respectively on two vertical sidewalls of the main frame;

wherein the terminal base is mounted upside down on the main frame to position the trenches on two sides of the terminal base within the tracks on two sides of the main frame, and the push buttons are embedded in the trenches of the terminal base so as to form a containing room between the terminal base and the main frame, wherein a female socket of a super-thin USB connector for receiving a male plug of a USB connector is thus formed.

2. The improved structure of the connector of claim 1, wherein the front end of the terminal base having the connection terminal mounted thereon extends from the main frame to form the male plug of the USB connector by pushing the push button.

3. An improved structure of a connector comprising:

a L-shaped terminal base having a plurality of connection terminal mounted orderly on one end of the terminal base and a first pivotal part formed respectively on two sides of the other end of the terminal base; and a main frame mated with a width of the terminal base, the main frame being formed by overlapping and combining a U-shaped insulating frame with a U-shaped plastic frame, a second pivotal part being mounted respectively on two vertical sidewalls of the main frame;

wherein the terminal base is mounted upside down on the main frame and the first and second pivotal parts are coupled with one another to form a containing room between the end of the terminal base and the main frame, wherein a female socket of a super-thin USB connector for receiving a male plug of a USB connector is thus formed.

4. The improved structure of the connector of claim 3, wherein the first and second pivotal parts of the terminal base and the main frame are rotating shafts and shaft holes that mate with one another, and the male plug of the USB connector is formed by turning the terminal base upward 90 degrees through the rotation of the rotating shafts.

5. An improved structure of a connector comprising:

a L-shaped terminal base having a plurality of connection terminal mounted orderly on one end of the terminal base and a first pivotal part formed on a center position of the other end of the terminal base; and a main frame mated with a width of the terminal base and formed by overlapping and combining a U-shaped insulating frame with a U-shaped plastic frame, a second pivotal part being mounted on a central connection surface of the main frame;

wherein the terminal base and the main frame are coupled with one another through the first and second pivotal parts to form a containing room between the terminal base and the main frame, wherein a female socket of a super-thin USB connector for receiving a male plug of a USB connector is thus formed.

6. The improved structure of the connector of claim 5, wherein the first and second pivotal parts of the terminal base and the main frame are a rotating shaft and a shaft hole that mate with one another, and the male plug of the USB connector is formed by rotating the terminal base on both sides through the rotation of the rotating shaft.

7. The improved structure of the connector of claim 5, wherein two sidewalls of the plastic frame of the main frame are connected to one another at a connection end that is higher than the two sidewalls, and the connection end is used as a stop during rotation of the terminal base on both sides.

* * * * *